US010180276B2

(12) United States Patent
Kim et al.

(10) Patent No.: US 10,180,276 B2
(45) Date of Patent: Jan. 15, 2019

(54) REFRIGERATOR

(71) Applicant: LG Electronics Inc., Seoul (KR)

(72) Inventors: Kyeongyun Kim, Seoul (KR); Kyungseok Kim, Seoul (KR); Kiho Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/549,932

(22) PCT Filed: Feb. 4, 2016

(86) PCT No.: PCT/KR2016/001231
§ 371 (c)(1),
(2) Date: Aug. 9, 2017

(87) PCT Pub. No.: WO2016/129862
PCT Pub. Date: Aug. 18, 2016

(65) Prior Publication Data

US 2018/0031301 A1 Feb. 1, 2018

(30) Foreign Application Priority Data

Feb. 9, 2015 (KR) ..... 10-2015-0019608

(51) Int. Cl.
*F25D 19/04* (2006.01)
*F25B 39/04* (2006.01)
(Continued)

(52) U.S. Cl.
CPC ..... *F25D 19/04* (2013.01); *F25B 39/00* (2013.01); *F25B 39/04* (2013.01); *F25D 11/022* (2013.01);
(Continued)

(58) Field of Classification Search
CPC ... F25D 17/065; F25D 11/022; F25B 2400/06
See application file for complete search history.

(56) References Cited

U.S. PATENT DOCUMENTS 4,201,065 A 5/1980 Griffin

FOREIGN PATENT DOCUMENTS

| | | | | |
|---|---|---|---|---|
| DE | 1179957 | | 10/1964 | |
| KR | 200443270 | | 1/2009 | |
| KR | 10-2011-0071167 | * | 6/2011 | ..... F25D 19/00 |

OTHER PUBLICATIONS

International Search Report in International Application No. PCT/KR2016/001231, dated May 24, 2016, 10 pages (with English translation).

* cited by examiner

*Primary Examiner* — Cassey D Bauer
(74) *Attorney, Agent, or Firm* — Fish & Richardson P.C.

(57) ABSTRACT

A refrigerator is disclosed. The refrigerator includes a first compressor (110) for compressing refrigerant, a first condenser for condensing refrigerant compressed by the first compressor, a first expansion valve for lowering temperature and pressure of refrigerant condensed by the first condenser, a first evaporator for evaporating refrigerant passed through the first expansion valve, a second compressor (210) for compressing refrigerant, a second condenser for condensing refrigerant compressed by the second compressor, a second expansion valve for lowering temperature and pressure of refrigerant condensed by the second condenser, and a second evaporator for evaporating refrigerant passed through the second expansion valve. The first condenser and second condenser include refrigerant tubes arranged to hold cooling fins in common, thereby forming a common-fin-held condenser (300).

5 Claims, 7 Drawing Sheets

(51) Int. Cl.

| | |
|---|---|
| ***F25D 23/00*** | (2006.01) |
| ***F25B 39/00*** | (2006.01) |
| ***F25D 11/02*** | (2006.01) |
| ***F28F 1/32*** | (2006.01) |

(52) U.S. Cl.
CPC ..... *F25D 23/006* (2013.01); *F28F 1/325* (2013.01); *F25B 2400/061* (2013.01)

[Fig. 1]
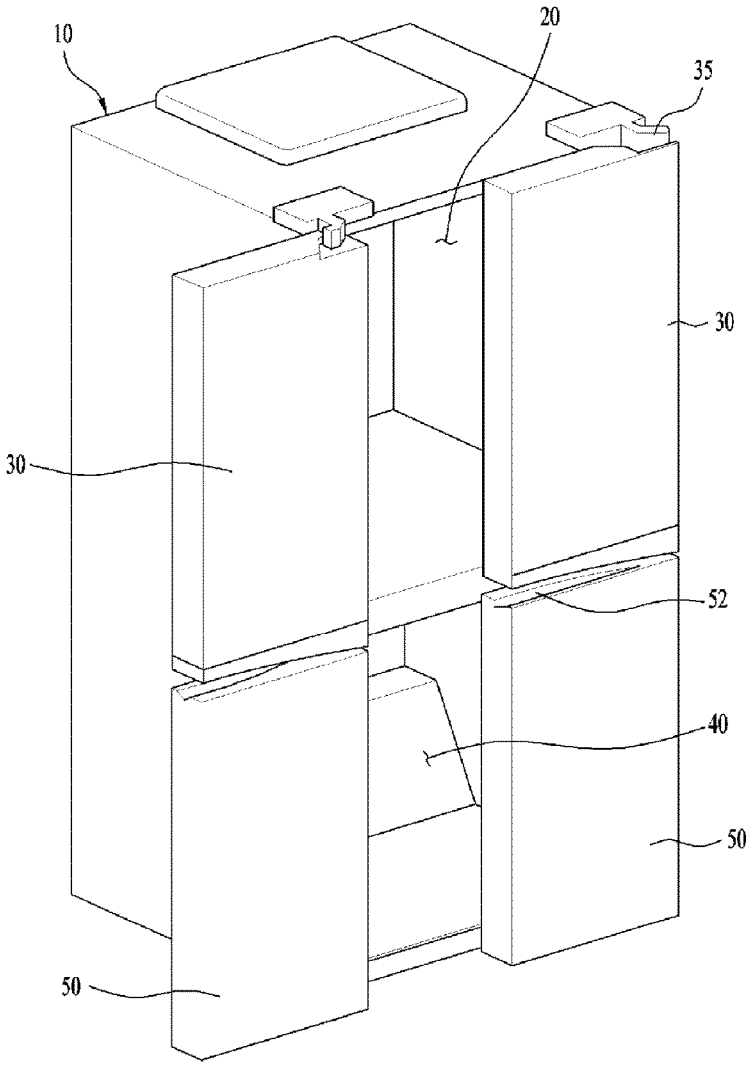

[Fig. 2]
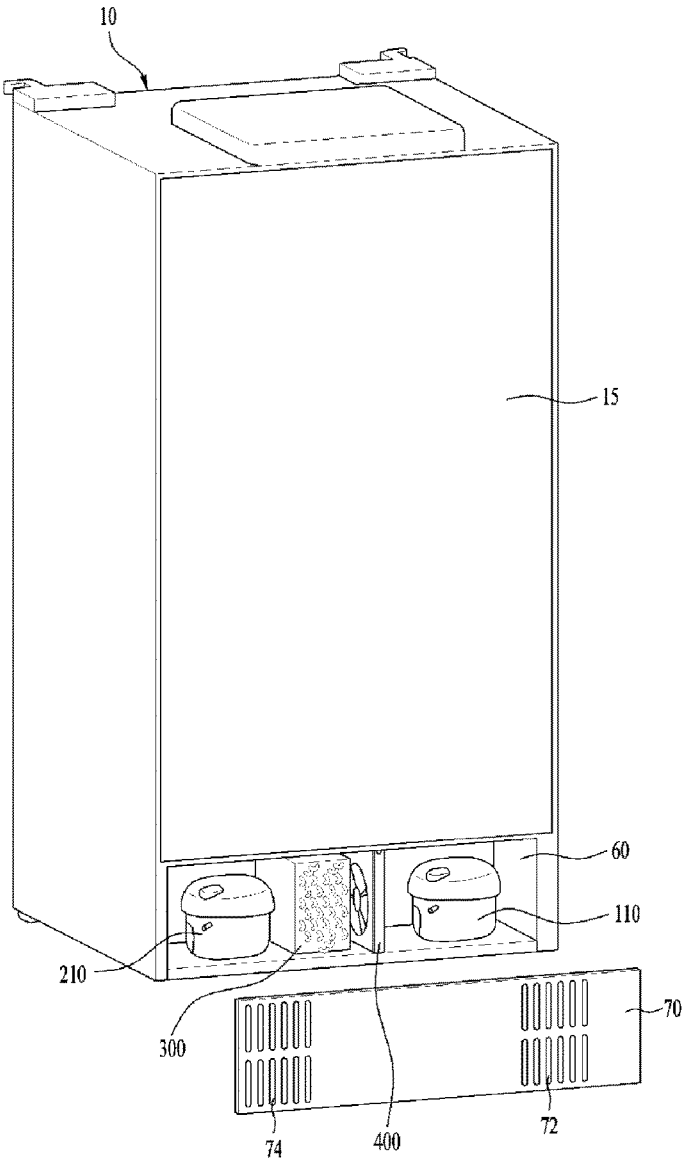

[Fig. 3]
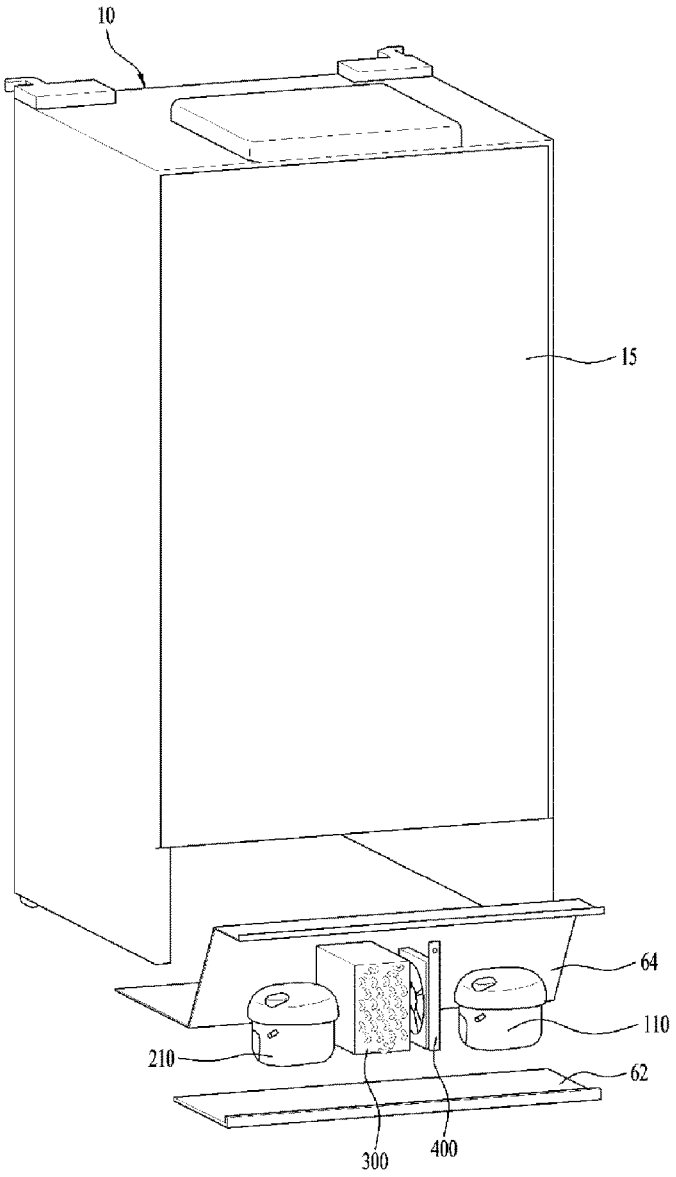

[Fig. 4]
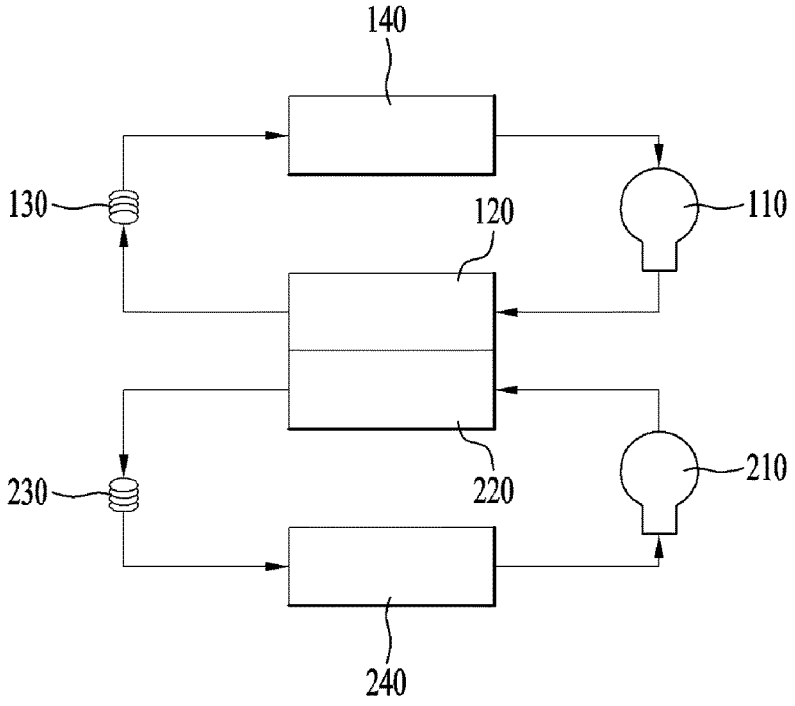

[Fig. 5]
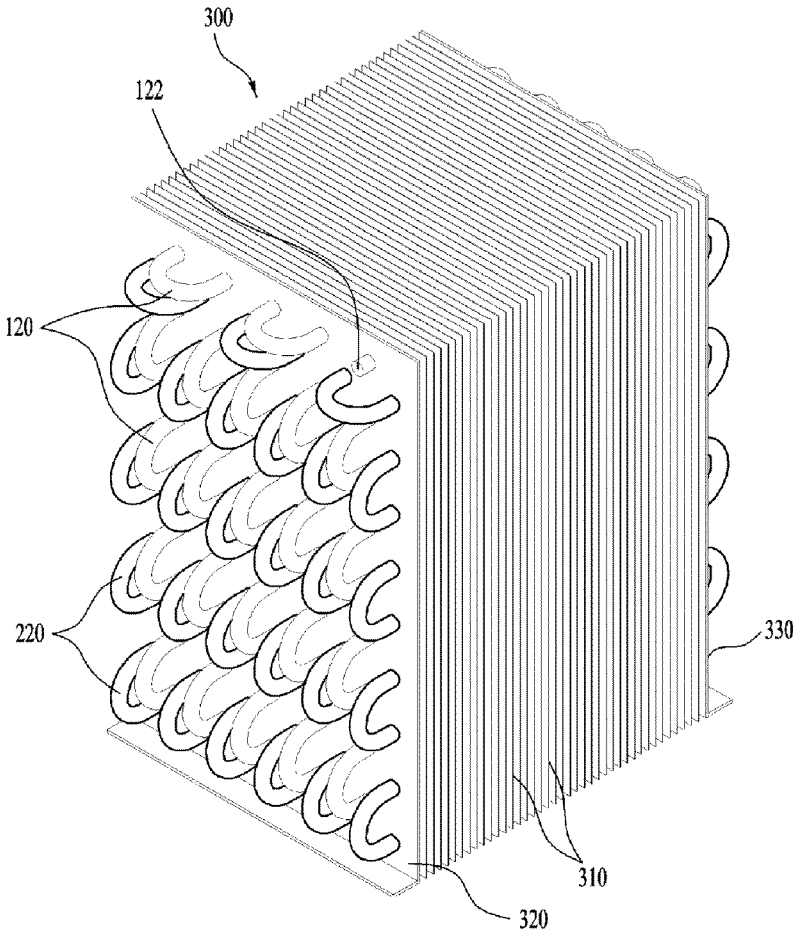

[Fig. 6]
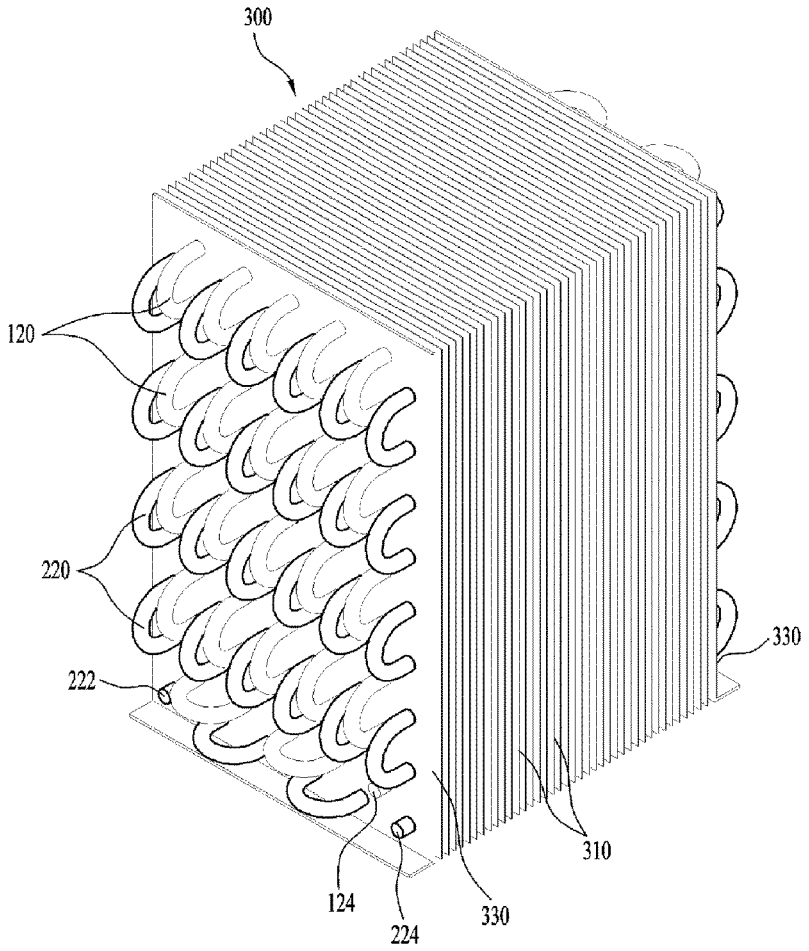

[Fig. 7]
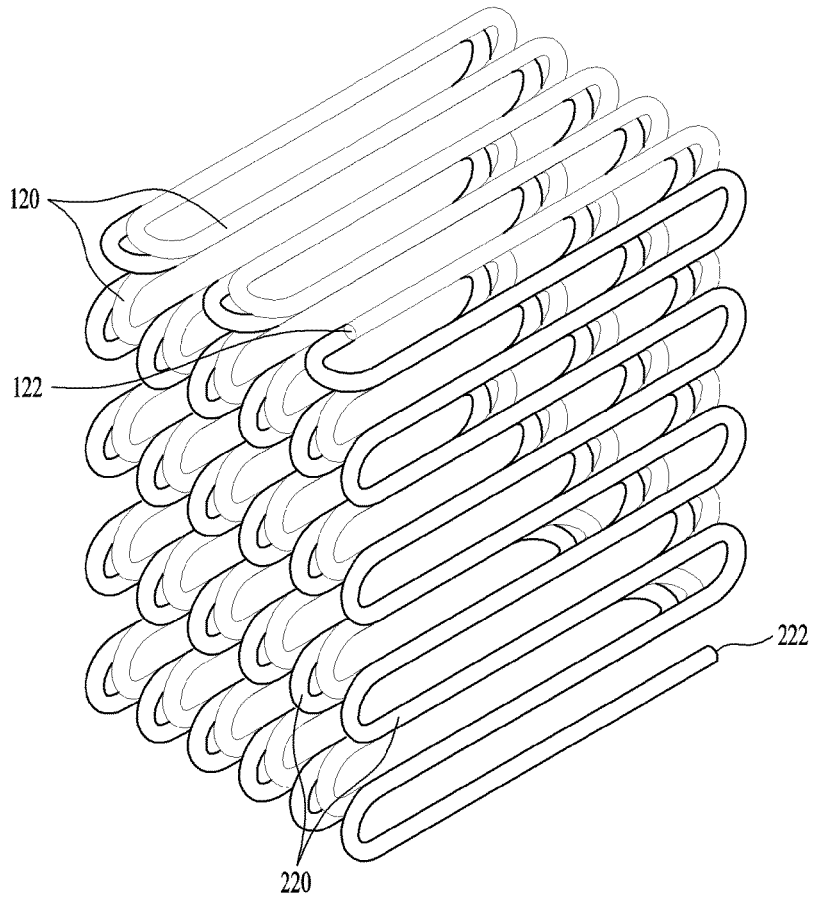

REFRIGERATOR

CROSS-REFERENCE TO RELATED APPLICATIONS

This application is a National Stage application under 35 U.S.C. § 371 of International Application No. PCT/KR2016/001231, filed Feb. 4, 2016, which claims the benefit of Korean Application No. 10-2015-0019608, filed on Feb. 9, 2015. The disclosures of the prior applications are incorporated by reference in their entirety.

TECHNICAL FIELD

The present invention relates to a refrigerator, and more particularly to a refrigerator in which two compressors and two condensers are installed in a machine room, and the condensers have refrigerant tubes holding cooling fins in common, respectively.

BACKGROUND ART

Generally, a refrigerator is an appliance for storing food, etc. within a storage chamber in a frozen or refrigerated state by discharging, into the storage chamber, cold air generated through a refrigeration cycle constituted by a compressor, a condenser, an expansion valve, an evaporator, etc., thereby lowering an internal temperature of the storage chamber.

Such a refrigerator includes, as storage compartments, a freezing compartment for storing food or beverages in a frozen state, and a refrigerating compartment for storing food or beverages at low temperature.

Refrigerators may be classified into a top mounting type refrigerator in which a freezing compartment is arranged over a refrigerating compartment, a bottom freezer type refrigerator in which a freezing compartment is arranged beneath a refrigerating compartment, and a side-by-side type refrigerator in which a freezing compartment and a refrigerating compartment are laterally arranged.

In a machine room provided within a cabinet of such a refrigerator, a compressor, a condenser, and a heat dissipating fan may be installed. An evaporator may be mounted behind a freezing compartment within the cabinet. Otherwise, evaporations may be mounted behind freezing and refrigerating compartments within the cabinet, respectively.

Meanwhile, recently developed refrigerators have a tendency toward an enlargement in capacity. Among such refrigerators, there is a refrigerator in which two compressors and two condensers are installed to supply cold air to a storage chamber having a large volume.

As mentioned above, in the case of a general refrigerator, a compressor, a condenser, and a heat dissipating fan are installed in a machine room. In addition, the compressor and condenser are connected by a refrigerant tube. In connection with this, in the case of a refrigerator having a large capacity, there is a difficulty in installing two compressors and two condensers in a machine room having a limited space.

When the volume of the machine room is increased to accommodate two compressors and two condensers therein, there is a problem in that the volume of the storage chamber is correspondingly reduced.

DISCLOSURE OF INVENTION

Technical Problem

An object of the present invention devised to solve the problem lies on a refrigerator in which two condensers have refrigerant tubes integrally formed while bolding cooling fins in common such that the condensers are installed in a machine room having a limited space, together with two compressors, thereby being capable of achieving increased space utility, and high refrigerant condensation efficiency.

Solution to Problem

The object of the present invention can be achieved by providing a refrigerator including a first compressor for compressing refrigerant, a first condenser for condensing refrigerant compressed by the first compressor, a first expansion valve for lowering temperature and pressure of refrigerant condensed by the first condenser, a first evaporator for evaporating refrigerant passed through the first expansion valve, a second compressor for compressing refrigerant, a second condenser for condensing refrigerant compressed by the second compressor, a second expansion valve for lowering temperature and pressure of refrigerant condensed by the second condenser, and a second evaporator for evaporating refrigerant passed through the second expansion valve, wherein the first condenser and the second condenser include refrigerant tubes arranged to hold cooling fins in common, respectively.

The cooling fins may include a plurality of thin metal plates each having a plurality of through holes, through which corresponding portions of the refrigerant tubes extend, respectively.

The refrigerant tube portions of the first condenser and the refrigerant tube portions of the second condenser may be arranged in a zigzag when viewed in a cross-section taken along a plane parallel to the cooling fins.

The first compressor, the first condenser, the second compressor, and the second condenser may be installed in a machine room provided at a lower portion of a cabinet.

A cooling fan may further be installed in the machine room such that the cooling fan is mounted between the first compressor and the second compressor.

The first compressor may be a refrigerator compartment compressor for compressing refrigerant, to supply cold air to a refrigerating compartment. The second compressor may be a freezing compartment compressor for compressing refrigerant, to supply cold air to a freezing compartment.

The second compressor may compress refrigerant at a higher pressure than the first compressor.

Advantageous Effects of Invention

In accordance with the above-described refrigerator, the two compressors and two condensers may be efficiently installed, in terms of space utility, in the machine room, which has a limited space, and the condensers may provide excellent heat dissipation efficiency.

In addition, since the two condensers independently perform condensation of refrigerant while holding the cooling fins in common, the refrigerating compartment and freezing compartment may be cooled in an independent manner or in a simultaneous manner.

BRIEF DESCRIPTION OF DRAWINGS

FIG. 1 is a perspective view illustrating a refrigerator according to an embodiment of the present invention.

FIG. 2 is a rear perspective view illustrating an interior of the machine room arranged at a rear lower portion of the refrigerator.

FIG. 3 is an exploded perspective view illustrating elements mounted in the machine room of FIG. 2.

FIG. 4 is a diagram briefly illustrating a refrigeration cycle applied to the refrigerator according to one embodiment of the present invention.

FIG. 5-7 are views illustrating a condenser 300 according to the present invention.

In accordance with the above-described refrigerator, the two compressors and two condensers may be efficiently installed, in terms of space utility, in the machine room, which has a limited space, and the condensers may provide excellent heat dissipation efficiency.

In addition, since the two condensers independently perform condensation of refrigerant while holding the cooling fins in common, the refrigerating compartment and freezing compartment may be cooled in an independent manner or in a simultaneous manner.

BEST MODE FOR CARRYING OUT THE INVENTION

Reference will now be made in detail to the preferred embodiments of the present invention, examples of which are illustrated in the accompanying drawings.

FIG. 1 is a perspective view illustrating a refrigerator according to an embodiment of the present invention.

The refrigerator illustrated in FIG. 1 is a bottom freezer type refrigerator in which a refrigerating compartment 20 is arranged at an upper portion of a cabinet 10, and a freezing compartment 40 is arranged at a lower portion of the cabinet 10.

The refrigerating compartment 20 can be opened or closed by a pair of refrigerating compartment doors 30 pivotally mounted to a front side of the refrigerating compartment 20 by hinges 35 provided at left and right sides of an upper end of the cabinet 10, respectively.

The freezing compartment 40 can be opened or closed by a pair of freezing compartment doors 50 pivotally mounted to the cabinet 10.

A handle groove 52 may be provided at an upper surface of each freezing compartment door 50. A handle groove (not shown) may be provided at a lower surface of each refrigerating compartment door 30.

The present invention is applicable not only to the above-described bottom freezer type refrigerator, but also to refrigerators of other types such as a top mount type refrigerator and a side-by-side type refrigerator.

FIG. 2 is a rear perspective view illustrating an interior of the machine room arranged at a rear lower portion of the refrigerator. FIG. 3 is an exploded perspective view illustrating elements mounted in the machine room of FIG. 2.

A machine room 60 is arranged at a rear lower portion of the cabinet 10. In the machine room 60, two compressors 110 and 210, a condenser 300, and a cooling fan 400 are installed.

A cover plate 70 formed with a plurality of air inlets 72 and a plurality of air outlets 74 may be mounted to a rear side of the machine room 60.

A rear plate 15 is mounted to a rear side of the cabinet 10. The rear plate 15 covers the rear side of the cabinet 10, except for a rear side portion of the cabinet 10 corresponding to the cover plate 70.

As illustrated in FIG. 3, the machine room 60 is provided at a space surrounded by a bottom plate 62, a top plate 64, and the cover plate 70.

The bottom plate 62 supports two compressors 110 and 210 mounted thereto. The bottom plate 62 also supports a condenser 300 having two refrigerant tubes integrally formed while holding cooling fins in common, and a cooling fan 400.

As illustrated in FIG. 3, the top plate 64 typically includes a front portion having a horizontal surface to form a bottom surface of the storage chamber, an intermediate portion having an inclined surface, and a rear portion having a horizontal surface to form a top surface of the machine room 60.

Although the machine room 60 is arranged at the rear lower portion of the cabinet 10 in the illustrated embodiment, the machine room 60 may be arranged at a top portion of the cabinet 10.

Similarly to the above-described case, two compressors and two condensers are installed in the case in which the machine room 60 is arranged at a top portion of the cabinet 10. In either case, it may be possible to reduce the size of the machine room, so long as the size of each condenser can be reduced through an improvement in structure of the condenser and, as such, the overall size of the cabinet may be reduced.

FIG. 4 is a diagram briefly illustrating a refrigeration cycle applied to the refrigerator according to the illustrated embodiment of the present invention.

The cooling cycle of the present invention includes a first refrigeration cycle for generating cold air to be supplied to the freezing compartment, and a second refrigeration cycle for generating cold air to be supplied to the refrigerating compartment.

The first refrigeration cycle includes a first compressor 110 for compressing refrigerant, a first condenser 120 for condensing refrigerant compressed by the first compressor 110, a first expansion valve 130 for lowering temperature and pressure of refrigerant condensed by the first condenser 120, and a first evaporator 140 for evaporating refrigerant passed through the first expansion valve 130.

The first evaporator 140 exchanges heat with air passing therearound, thereby lowering temperature of the air, and, as such, generates cold air.

The second refrigeration cycle includes a second compressor 210 for compressing refrigerant, a second condenser 220 for condensing refrigerant compressed by the second compressor 210, a second expansion valve 230 for lowering temperature and pressure of refrigerant condensed by the second condenser 220, and a second evaporator 240 for evaporating refrigerant passed through the second expansion valve 230.

Similarly to the first evaporator 140, the second evaporator 240 exchanges heat with air passing therearound, thereby lowering temperature of the air, and, as such, generates cold air.

The refrigerant of the first refrigeration cycle and the refrigerant of the second refrigeration cycle may generate cold air to be supplied to the freezing compartment and cold air to be supplied to the refrigerating compartment, respectively, while circulating independently.

The refrigerant tubes of the first and second condensers 120 and 220 are arranged to hold cooling fins in common.

That is, the first and second condensers 120 and 220 are fin-tube type heat exchangers, and the refrigerant tubes are arranged to hold cooling films in common.

Accordingly, since the first condenser 120 and second condenser 220 are integrally manufactured to hold cooling fins in common, condenser size is reduced and, as such, the resultant condenser exhibits sufficient condensation performance while having increased space utility, thereby achieving high heat exchange efficiency, as compared to the conventional case in which condensers have refrigerant tubes manufactured to be separated from each other while having separate cooling fins.

FIGS. 5 to 7 are views illustrating a common-fin-held condenser 300 according to the present invention.

In FIGS. 5 to 7, the refrigerant tube of the first condenser 120 is represented by a thin solid line, and the refrigerant tube of the second condenser 220 is represented by a thick solid line.

Preferably, each refrigerant tube has portions respectively extending through a plurality of through holes provided at cooling fins 310 arranged in perpendicular to the refrigerant tubes while being spaced apart from one another by a predetermined distance. The cooling fins 310 have a thin metal plate structure.

The cooling fins 310 forming front and rear surfaces of the common-fin-held condenser 300, namely, cooling fins 320 and 330, are thicker than the remaining cooling fins 310, to support the entirety of the condenser 300.

Lower ends of the cooling fins 320 and 330 may be bent to be supported by the bottom surface of the machine room 60.

The condenser 300 may be fastened to the bottom surface of the machine room 60 by screws under the condition that the bent lower ends of the cooling fins 320 and 330 contact the bottom surface of the machine room 60.

The refrigerant tube portions of the first condenser 120 and the refrigerant tube portions of the second condenser 220 are preferably arranged in a zigzag when viewed in a cross-section taken along a plane parallel to the cooling fins 310.

In the condenser 300 of the present invention, the refrigerant tube portions are more densely arranged than those in the conventional case in which two condensers are separate from each other. In the condenser 300 of the present invention, however, a desired distance is maintained between the adjacent refrigerant tube portions because the refrigerant tube portions are arranged in a zigzag and, as such, the refrigerant tube portions can exhibit sufficient heat exchange performance while occupying a reduced space.

In the condenser 300 illustrated in FIGS. 5 and 6, the refrigerant tube portions of the first condenser 120 are arranged in 9 rows and 5 columns, and the refrigerant tube portions of the second condenser 220 are arranged in 9 rows and 6 columns.

In this case, the inlet of the refrigerant tube of the first condenser 120, namely, an inlet 122, may be disposed at a front side of the condenser 300. On the other hand, the outlet of the refrigerant tube of the first condenser 120, namely, an outlet 124, and the inlet and outlet of the refrigerant tube of the second condenser 220, namely, an inlet 222 and an outlet 224, may be disposed at a rear side of the condenser 300.

The illustrated condenser 300 is only exemplary, and may have a refrigerant tube arrangement having reduced or increased numbers of rows and columns.

For example, the refrigerant tube portions of the first condenser 120 are arranged in 8 rows and 4 columns, and the refrigerant tube portions of the second condenser 220 are arranged in 8 rows and 4 columns.

In this case, the refrigerant tube inlet and outlet of the first condenser 120 and the refrigerant tube inlet and outlet of the second condenser 220 may be disposed at the front side or rear side of the condenser 300.

Generally, the cooling cycle for cooling the freezing compartment has a greater cooling capacity than that of the refrigerating compartment. Accordingly, the numbers of rows and columns of the refrigerant tube portions in the second condenser 220 are equal to or greater than those in the first condenser 120.

As illustrated in FIG. 2, the first compressor 110, first condenser 120, second compressor 210, and second condenser 220 are installed in the machine room 60 provided at the lower portion of the cabinet 10.

Since the first condenser 120 and second condenser 220 have refrigerant tube portions arranged in a zigzag while holding the cooling fins each having a thin metal plate structure, the space occupied by the first and second condensers 120 and 220 may be greatly reduced, as compared to the conventional case in which two condensers are manufactured to be separate from each other.

The condenser 300 may be mounted between the first compressor 110 and the second compressor 210 in the machine room 60. The cooling fan 400 may be mounted between the condenser 300 and the first compressor 110.

The cooling fan 400 forces ambient air to be introduced into the machine room 60 through the air inlets 72 provided at the cover plate 70, thereby cooling the first compressor 110 by the introduced air. Subsequently, the introduced air is forced to pass around the condenser 300, and is then blown to the second compressor 210, to cool the second compressor 210.

After dissipating heat from elements installed in the machine room 60, the air is discharged to the outside through the air outlets 74 provided at the cover plate 70.

The first compressor 110 may be a compressor for the refrigerating compartment, to compress refrigerant for supply of cold air to the refrigerating compartment. The second compressor 210 may be a compressor for the freezing compartment, to compress refrigerant for supply of cold air to the freezing compartment.

In this case, accordingly, the second compressor 210 requires a greater compression capacity than the first compressor 110. In this regard, the second compressor 210 is preferably a high-pressure compressor capable of compressing refrigerant at a higher pressure than the first compressor 110.

Since the second compressor 210 compresses refrigerant at a higher pressure, the temperature of cold air generated by the second evaporator 240 may be lower than the temperature of cold air generated by the second evaporator 140.

MODE FOR THE INVENTION

Various embodiments have been described in the best mode for carrying out the invention.

INDUSTRIAL APPLICABILITY

As apparent from the above description, in accordance with the present invention, two condensers have refrigerant tube portions arranged in a zigzag while holding cooling fins each having a thin metal plate structure, the space occupied by the condensers in a machine room may be greatly reduced, and desired condensation performance may be efficiently exhibited, as compared to the conventional case in which two condensers are manufactured to be separate from each other.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A refrigerator comprising:

a first compressor that is configured to compress refrigerant;

a first condenser that is configured to condense refrigerant compressed by the first compressor;

a first expansion valve that is configured to lower temperature and pressure of refrigerant condensed by the first condenser;

a first evaporator that is configured to evaporate refrigerant passed through the first expansion valve;

a second compressor that is configured to compress refrigerant;

a second condenser that is configured to condense refrigerant compressed by the second compressor;

a second expansion valve that is configured to lower temperature and pressure of refrigerant condensed by the second condenser;

a second evaporator that is configured to evaporate refrigerant that passes through the second expansion valve; and a cooling fin that includes a plurality of metal plates arranged in parallel to each other, wherein each of the plurality of metal plates have through holes;

wherein each of the refrigerant tubes of the first condenser and the second condenser is configured to pass through the through holes of the plurality of metal plates to share the cooling fins, and wherein the through holes of the plurality of metal plates into which the refrigerant tubes of the first condenser are inserted and the through holes of the plurality of metal plates into which the refrigerant tubes of the second condenser are inserted are provided at different heights, and are positioned at different positions in the left and right width direction of the plurality of metal plates respectively.

2. The refrigerator according to claim 1, wherein the first compressor, the first condenser, the second compressor, and the second condenser are installed in a machine room provided at a lower portion of a cabinet.

3. The refrigerator according to claim 2, wherein a cooling fan is installed in the machine room and is mounted between the first compressor and the second compressor.

4. The refrigerator according to claim 1, wherein:

the first compressor is a refrigerator compartment compressor that is configured to compress refrigerant, to supply cold air to a refrigerating compartment; and the second compressor is a freezing compartment compressor that is configured to compress, to supply cold air to a freezing compartment.

5. The refrigerator according to claim 4, wherein the second compressor compresses refrigerant at a higher pressure than the first compressor.

* * * * *